United States Patent [19]

O'Neill et al.

[11] Patent Number: 4,786,855

[45] Date of Patent: Nov. 22, 1988

[54] REGULATOR FOR CURRENT SOURCE TRANSISTOR BIAS VOLTAGE

[75] Inventors: Dennis P. O'Neill, Mountain View; Carl T. Nelson, San Jose, both of Calif.

[73] Assignee: Linear Technology Inc., Milpitas, Calif.

[21] Appl. No.: 152,169

[22] Filed: Feb. 4, 1988

[51] Int. Cl.[4] ..... G05F 3/30

[52] U.S. Cl. ..... 323/314; 323/315; 323/901

[58] Field of Search ..... 323/313, 314, 315, 316, 323/901

[56] References Cited

U.S. PATENT DOCUMENTS

| | | | |
|---|---|---|---|
| 3,886,435 | 5/1975 | Steckler | 323/901 |
| 4,123,698 | 10/1978 | Timko et al. | 323/901 |
| 4,287,467 | 9/1981 | Gloaguen | 323/314 |
| 4,567,426 | 1/1986 | van de Plassche et al. | 323/901 |
| 4,567,537 | 1/1986 | Kalkhof et al. | 323/315 |
| 4,574,233 | 3/1986 | Taylor | 323/315 |

OTHER PUBLICATIONS

National Semiconductor Data Sheet for LM134/LM234/LM334 3-Terminal Adjustable Current Source.

*Primary Examiner*—Peter S. Wong

*Attorney, Agent, or Firm*—Flehr, Hohbach, Test, Albritton & Herbert

[57] ABSTRACT

A bias control loop forms a voltage regulator for providing the bias voltage to the collectors of bipolar current source transistors in a linear circuit. The bias loop functions by maintaining equal or related base/emitter voltages on the several transistors. By properly sizing the emitter areas of the transistors, interrelated voltages and transistor biases are provided in the loop. The bias loop works down to less than 1 volt and is stable without a compensation capacitor.

7 Claims, 1 Drawing Sheet

REGULATOR FOR CURRENT SOURCE TRANSISTOR BIAS VOLTAGE

Figure 1:
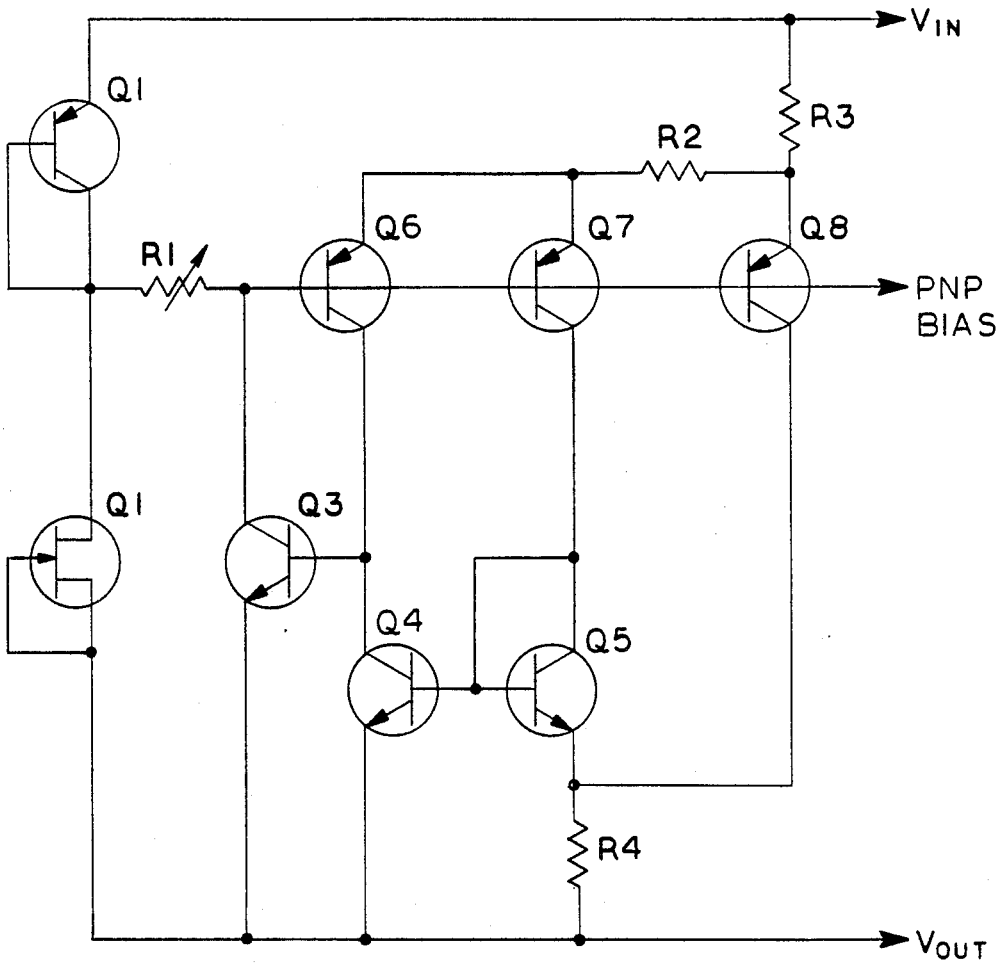

This invention relates generally to regulator circuitry, and more particularly the invention relates to a bias control loop for controlling current source transistors.

Linear circuits utilize current sources in the form of biased bipolar transistors. Accurate control of the base/emitter voltage of the transistors is required in providing constant current.

An object of the present invention is a bias loop for bipolar current sources.

A feature of the invention is a control loop including a plurality of current paths with the ratios of currents established by transistors having related base/emitter voltages.

The invention and objects and features thereof will be more readily apparent from the following detailed description and appended claims when taken with the drawing, which is a schematic of a bias control loop regulator in accordance with a preferred embodiment of the invention.

Referring now to the drawing, a schematic is illustrated of a preferred embodiment of a bias control loop regulator in accordance with the invention which comprises transistors Q3–Q8 and resistors R2–R4. The control loop is interconnected with transistor (diode) Q1, transistor Q2, and resistor R1.

Transistor Q1 is a PNP bipolar transistor having a shorted base/collector, thereby functioning as a diode, which is serially connected with a field effect transistor Q2 between a voltage in ($V_{in}$) terminal and a voltage out ($V_{out}$) terminal. The diode function of transistor Q1 and the resistive function of transistor Q2 along with resistor R1 connected to the common terminal thereof are necessary only under initial start-up conditions, and provide a base bias for PNP transistors Q6, Q7 and Q8. Thereafter, the base bias is provided by transistor Q3.

Transistor Q8 is serially connected to resistor R3 and resistor R4 between the $V_{in}$ and $V_{out}$ terminals. The emitters of transistors Q6 and Q7 are connected through resistor R2 and resistor R3 to the $V_{in}$ terminal. Thus the transistors Q6 and Q7 are forced to run at equal currents since the two transistors have the same base/emitter voltage.

The collector of transistor Q6 is connected to the collector of NPN transistor Q4 with the emitter of transistor Q4 connected to the $V_{out}$ terminal. The collector of transistor Q7 is connected to the shorted collector/-base terminals of NPN transistor Q5 with the emitter of transistor Q5 connected through resistor R4 to the $V_{out}$ terminal. The ratio of the emitter areas for transistors Q5 and Q4 is 10:1. Therefore, if transistors Q4 and Q5 run at equal currents, there will be approximately a 60 millivolt difference in their base/emitter voltages which must appear at the emitter of transistor Q5. The sum of the current flowing through transistor Q5 and the current flowing through transistor Q8 flows through resistor R4, and the voltage drop across resistor R4 must be approximately 60 millivolts. In the illustrated embodiment with resistor R2 equal to 1.2 KΩ, and resistor R4 equal to 267Ω the currents flowing through transistors Q6 and Q7 are 25 microamperes each, while the current flowing through transistor Q8 is 200 microamperes. The ratio of the currents between transistor Q6 and transistor Q8 and between transistor Q7 and transistor Q8 is determined by the value of resistor R2.

Once the transistors are biased to conduct and the current establishes a steady state, the bias loop establishes a stable voltage for providing base bias to PNP current source transistors. The bias loop works down to less than 1 volt and is stable without a compensation capacitor, due to the degenerative active of R2.

While the invention has been described with reference to a preferred embodiment, the description is illustrative of the invention and not to be construed as limiting the invention. Various modifications and applications may occur to those skilled in the art without departing from the true spirit and scope of the invention as defined by the appended claims.

What is claimed is:

1. A bias voltage regulator comprising
   - a first bipolar transistor having a collector, a base, and an emitter,
   - first means connecting the emitter of said first bipolar transistor to a first voltage line,
   - a second bipolar transistor having a collector, a base, and an emitter,
   - a third bipolar transistor having a collector, a base, and an emitter,
   - first resistive means connecting the emitter of said first transistor to the emitters of said second transistor and said third transistor,
   - a fourth bipolar transistor having a collector, a base, and an emitter,
   - means connecting the collector of said fourth transistor to the bases of said first transistor, said second transistor and said third transistor,
   - means connecting the emitter of said fourth transistor to a second voltage line,
   - a fifth bipolar transistor having a collector, a base, and an emitter,
   - means connecting the collector of said fifth transistor to the collector of said second transistor and to the base of said fourth transistor,
   - means connecting the emitter of said fifth transistor to said second voltage line,
   - a diode means having two terminals,
   - means connecting one terminal of said diode means to the base of said fifth transistor and to the collector of said third transistor,
   - means connecting the other terminal of said diode means to the collector of said first transistor, and
   - a second resistive means connecting the other terminal of said diode means and the collector of said first transistor to said second voltage line, whereby current through said first transistor is established by said first means and said second resistive means, and currents through said second transistor and said third transistor are established by said first resistive means.

2. The regulator as defined by claim 1 wherein said diode means comprises a sixth bipolar transistor having a collector, a base and an emitter with means shorting the collector to the base of said sixth transistor.

3. The regulator as defined by claim 2 wherein the emitter area of said sixth transistor is larger than the emitter area of said fifth transistor whereby the base/emitter voltage of said sixth transistor and the base/emitter voltage of said fifth transistor have a difference which appears across said second resistive means.

4. The regulator as defined by claim 1 and further including third resistive means connecting the bases of said first transistor, said second transistor and said third transistor to a voltage potential for initial start-up.

5. The regulator as defined by claim 4 and further including a second diode means and a fourth resistive means serially connected between said first voltage line and said second voltage line, said third resistive means interconnecting the common terminal of said second diode means and said fourth resistive means to the bases of said first transistor, said second transistor, and said third transistor for biasing said transistors during initial circuit start-up.

6. The regulator as defined by claim 5 wherein said first means comprises a resistor.

7. The regulator as defined by claim 1 wherein said first means comprises a resistor.

* * * * *

UNITED STATES PATENT AND TRADEMARK OFFICE

CERTIFICATE OF CORRECTION

PATENT NO. : 4,786,855

DATED : Nov. 22, 1988

INVENTOR(S) : Dennis P. O'Neill and Carl T. Nelson

It is certified that error appears in the above—identified patent and that said Letters Patent is hereby corrected as shown below:

In the drawing, the field effect transistor labelled "Q1" is --Q2--.

In the Abstract, line 2, change "collectors" to --bases--.

In the Specification, column 2, line 8, change "active" to --action--.

Signed and Sealed this

First Day of August, 1989

*Attest:*

*Attesting Officer*

DONALD J. QUIGG

*Commissioner of Patents and Trademarks*